US008267338B2

(12) United States Patent
Chen

(10) Patent No.: US 8,267,338 B2
(45) Date of Patent: Sep. 18, 2012

(54) SAFETY INLET APPARATUS FOR A PAPER FEED OPENING OF A SHREDDER

(75) Inventor: Hsin-Hsiung Chen, Shanghai (CN)

(73) Assignee: Aurora Office Equipment Co., Ltd. Shanghai (CN)

( * ) Notice: Subject to any disclaimer, the term of this patent is extended or adjusted under 35 U.S.C. 154(b) by 300 days.

(21) Appl. No.: 12/838,209

(22) Filed: Jul. 16, 2010

(65) Prior Publication Data

US 2011/0024535 A1 Feb. 3, 2011

(30) Foreign Application Priority Data

Jul. 31, 2009 (CN) ..... 2009 1 0055706

(51) Int. Cl.
*B02C 23/00* (2006.01)

(52) U.S. Cl. ..... 241/37.5; 241/100

(58) Field of Classification Search ..... 241/37.5, 241/100, 236

See application file for complete search history.

(56) References Cited

U.S. PATENT DOCUMENTS

| | | | | |
|---|---|---|---|---|
| 4,411,391 | A | 10/1983 | Crane | |
| 4,817,877 | A | 4/1989 | Itoh et al. | |
| 4,842,205 | A | 6/1989 | Araki et al. | |
| 5,044,270 | A | 9/1991 | Schwelling | |
| 5,969,310 | A | 10/1999 | Schwelling | |
| 6,065,696 | A | 5/2000 | Tsai | |
| 6,116,528 | A | 9/2000 | Schwelling | |
| 6,676,050 | B2 | 1/2004 | Chang | |
| 6,682,006 | B2 | 1/2004 | Lee | |
| 6,964,386 | B2 | 11/2005 | Ho | |
| 7,083,131 | B2 | 8/2006 | Ting | |
| 7,414,212 | B2 | 8/2008 | Huang | |
| 8,079,537 | B2 * | 12/2011 | Chen | 241/37.5 |
| 8,091,809 | B2 * | 1/2012 | Hu et al. | 241/30 |
| 2006/0054725 | A1 | 3/2006 | Matlin | |
| 2006/0219827 | A1 | 10/2006 | Matlin et al. | |
| 2007/0012808 | A1 | 1/2007 | Kao | |
| 2007/0034725 | A1 | 2/2007 | Duh | |
| 2007/0246581 | A1 | 10/2007 | Matlin et al. | |
| 2008/0006728 | A1 | 1/2008 | Zhang | |
| 2008/0105772 | A2 | 5/2008 | Matlin | |
| 2008/0156912 | A1 | 7/2008 | Huang | |
| 2008/0164351 | A1 | 7/2008 | Wang | |
| 2008/0169369 | A1 | 7/2008 | Wang | |

FOREIGN PATENT DOCUMENTS

| | | |
|---|---|---|
| CN | 200910055706 | 7/2009 |
| WO | WO2009/058225 | 5/2009 |

* cited by examiner

*Primary Examiner* — Faye Francis
(74) *Attorney, Agent, or Firm* — WHGC, PLC; John F. O'Rourke; Eric P. Wolf

(57) ABSTRACT

Safety inlet apparatus for a shredder paper feed opening includes upper cover, safety cover, paper feed passage block, and elastic member. A safety cover end section covers the shredder paper feed opening, and rotatably couples to the upper cover. Paper feed passage block is positioned between shredder paper feed opening and elastic member, and the safety cover pivots to the upper cover. Paper feed passage block is slidably arranged on the upper cover near shredder paper feed opening, connecting to the safety cover second end section. Elastic member ends respectively connect to the upper cover inner wall and the paper feed passage block. Paper feed passage block may be fixed to, or integrated with, the second end section, or may limit a stud on the second end section.

8 Claims, 3 Drawing Sheets

SAFETY INLET APPARATUS FOR A PAPER FEED OPENING OF A SHREDDER

CROSS-REFERENCES TO RELATED PATENTS AND APPLICATIONS

This U.S. patent application is related to co-pending U.S. application Ser. No. 11/980,176, entitled "Safety Shredder," which was filed on Oct. 30, 2007, which is assigned to the same assignee hereof, which is relied upon under Chinese Application No. 200910055706 filed Jul. 31, 2009, for priority, and which is incorporated herein by reference in its entirety.

TECHNICAL FIELD

The present utility model relates to the technical field of a paper shredder, particularly to a protection apparatus for a paper shredder, and more particularly, to a paper shredder feed opening safety inlet apparatus.

BACKGROUND ART

Paper shredders currently in the consumer and business markets have a narrow gap through which paper is fed to the shredder cutting apparatus. By design, the gap in a paper feed passage is limited in size, to protect a user or other party from inadvertently coming into contact with the shredder blade, or to protect the shredder blade apparatus by limiting the opening into which foreign matter may fall. When excessive paper is pushed into the feed opening (an "overfeed"), a thick cluster, or a bolus, of paper may form in, and may block, paper feed passage. A shredder may aim to protect a user during a paper overfeed by stopping the shredder action, for example, by actuating a switch the feed passage, causing the shredder motor to stop.

As the bolus of paper in the paper feed passage move deep into the passage, or causes the shredder to stop operation, the usual gap in paper feed passage can be widened, allowing foreign matter to enter paper feed passage, and further endangering a paper shredder user. However, complex apparatus attempting to solve the problem tend to be unacceptably costly. There is a need for paper shredder feed opening safety apparatus, which can improve user safety at a lower cost.

SUMMARY OF THE INVENTION

Accordingly a safety inlet apparatus for a paper feed opening of a shredder includes an upper cover, a safety cover, a paper feed passage block connected to the safety cover, and an elastic member connected to the upper cover and to the paper feed passage block. The upper cover includes a paper feed passage with a passage entrance and an upper cover inner wall that connects to the elastic member. The safety cover is rotatably coupled to the upper cover, with a first end section of the safety cover being rotatable to cover the passage inlet. Also, the paper feed passage block is connected to a second end section of the safety block, and is slidably disposed on the upper cover to move toward the paper feed passage, and limiting safety cover movement. Furthermore, movement of the elastic member resiliently actuates the safety cover to rotate toward closure of the passage inlet or entrance.

In other embodiments of the safety inlet apparatus, the paper feed passage block is fixed to the second end section. In some of these embodiments of the safety inlet apparatus, the paper feed passage block is integrated with the second end section.

In yet other embodiments of the safety inlet apparatus, the paper feed passage block is disposed between the paper feed passage and the elastic member. In still other embodiments of the safety inlet apparatus, the elastic member includes a tension spring. Further embodiments provide at least one stud on the second end section of the safety cover, and at least one stud is limited by the paper feed passage block.

In still further embodiments, the safety cover is pivotably coupled to the upper cover. In some embodiments of the pivotably coupled safety cover, rotating axles provided on sides of the safety cover and axle seats are facingly disposed on the upper cover. The axel seats are positioned to receive a respective rotating axel, and the rotating axels of the safety cover are respectively mounted in the axle seats.

BRIEF DESCRIPTION OF THE DRAWINGS

The invention is generally shown by way of reference to the accompanying drawings in which.

DESCRIPTION OF THE EMBODIMENTS

Figure 1:
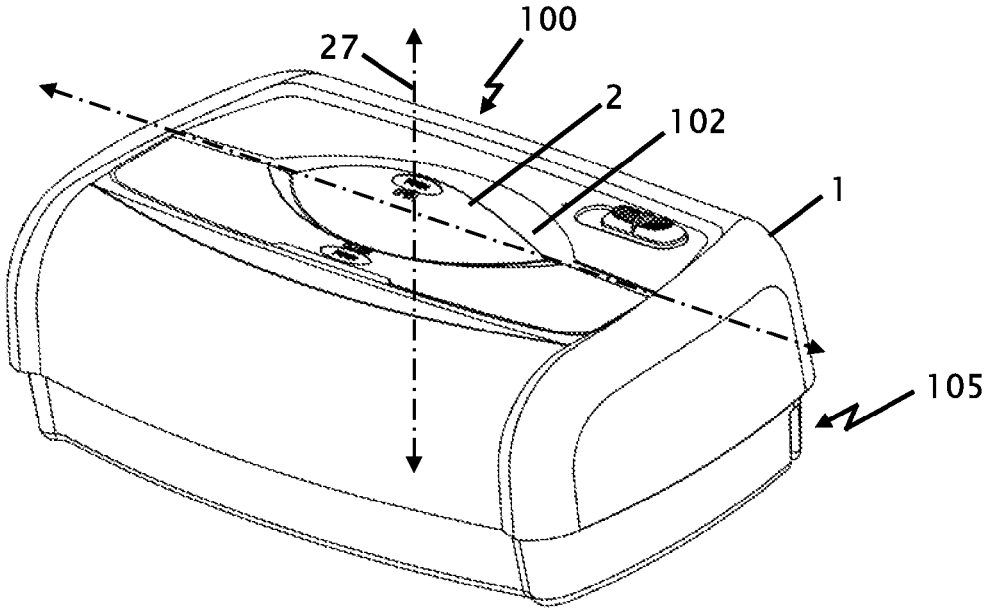
FIG. 1 is a top perspective view of one embodiment of a paper shredder in accordance with the present invention.
Figure 2:
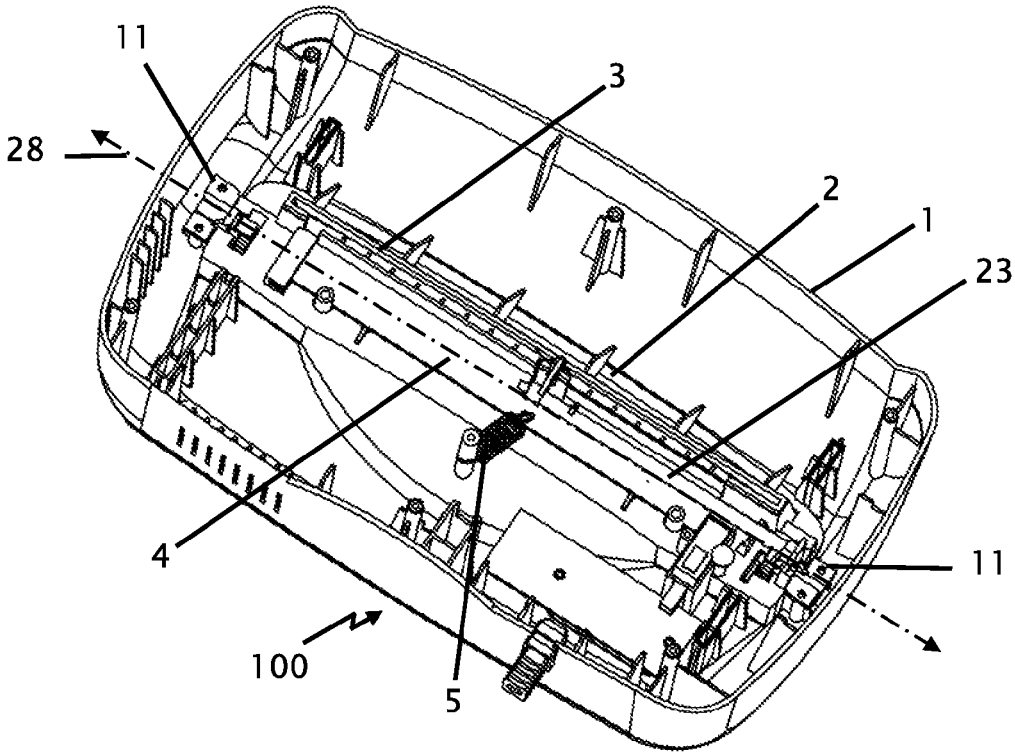
FIG. 2 is a bottom perspective view of paper shredder embodiment as shown in FIG. 1.

Embodiments of the present invention can provide an inexpensive, reliable, and convenient solution to potential hazard and safety problems arising from an enlarged paper shredder feed inlet or opening. In accordance with the following description, certain embodiments of a safety inlet apparatus for paper shredder can be realized, inter alia, using a constrainedly rotatable safety cover including a passage feed block in the paper feed inlet.

In general, during normal operation, the safety cover can be opened to create an acceptable gap. When excessive paper or foreign matter is introduced into paper feed passage, the safety cover tends to be forced open, which further tends to push paper feed passage block into paper feed passage, thereby closing paper feed passage. Feed passage closure during paper feed passage overloading can provide a significant safeguard for a paper shredder user. An elastic member, such as a tension spring, can provide a force to reset paper feed passage block, when the amount of paper fed to the shredder is reduced below an excessive limiting thickness, or when a comparable thickness of foreign matter is removed.

Referring to FIGS. 1-4, example embodiments of safety inlet apparatus 100 for a paper feed opening 102 of a paper shredder 105, in general, can include, without limitation, upper cover 1 and safety cover 2. Paper shredder 105 may be used horizontally above, and in conjunction with, a waste bin (not shown), or other device to receive shredded materials.

Upper cover 1 further includes paper feed passage 3. The safety cover 2 further includes a first end section 21, a second end section 22, and pivoting portion 25 therebetween. First end section 21 and second end section 22 generally are aligned to longitudinal axis 27, with pivoting portion 25 being generally aligned to transverse axis 28.

Typically, safety cover 2 can be rotatably coupled to the upper cover 1, aligned with axis 28. First end section 21 can be formed to reversibly cover the entrance to paper feed passage 3. Safety protection apparatus also can include paper feed passage block 4 and elastic member 5. Paper feed passage block 4 can be slidably arranged on the upper cover 1 disposed towards paper feed passage 3. Paper feed passage block 4 can be disposed to limit second end section 22. Alternatively, paper feed passage block 4 can be disposed to connect with second end section 22. Typically, the two ends of elastic member 5 can be connected to the inner wall of the upper cover 1 and to paper feed passage block 4, respectively. Elastic member 5 may be, without limitation, a coil spring in tension, although other resilient materials may be used for elastic member 5.

Paper feed passage block 4 can be arranged between paper feed passage 3 and elastic member 5, although other arrangements mat be substituted. Tension spring 5 functions when paper feed passage block 4 extends into paper feed passage 3, and resets paper feed passage block 4 with tension force. Paper feed passage block 4 also may be arranged at one side of paper feed passage 3 and elastic member 5. That is, elastic member 5 and paper feed passage 3 may be arranged at the same side in reference to the paper feed passage block 4. Paper feed passage block 4 enters the paper feed passage 3 by tightly pressing elastic member 5 and will empty the passage and reset with the aid of the elastic force of elastic member 5. Also, at least one stud 23 can be provided at second end section 22 and may limit paper feed passage block 4. However, in the depicted example embodiment, two studs 23 are provided at the second end section 22. Safety cover 2 can be pivotably connected to the upper cover 1, and generally can pivot along transverse axis 28. As depicted in FIG. 1 through FIG. 4, two rotating axles can be disposed at either side of safety cover 2, with respective axle seats 11 facing each other set in the upper cover 1. Safety cover 2 can be mounted between respective facing axle seats 11 with respective rotating axles being seated therein.

When no paper is being fed, the entrance to paper feed passage 3 can be covered by safety cover 2 and may be tightly closed. When in use, safety cover 2 can rotate up to a limiting rotation angle to form a gap in paper feed passage 3, allowing a limited thickness of paper to pass through paper feed passage 3. At a rotation angle greater than the limiting rotation angle, the amount of paper being placed into paper feed passage 3 is considered to be excessive. In addition, foreign matter having a thickness greater than the comparable limiting thickness for paper also may be considered to have excessive thickness.

Figure 3:
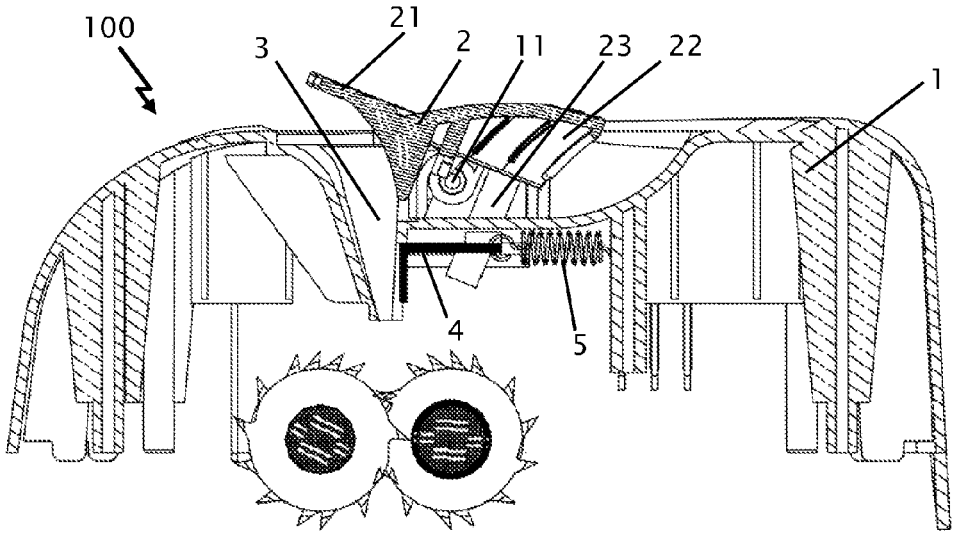
FIG. 3 is a partial cross-sectional view of the shredder embodiment in normal operation as shown in the embodiment of FIG. 1 and FIG. 2, in accordance with the teachings of the present invention.

In the embodiment depicted in FIG. 3, studs 23 on second end section 22 of safety cover 2 typically do not touch paper feed block 4. However, even if studs 23 touch paper feed block 4, for example by feed passage 3 receiving the limited thickness of paper, studs 23 still fail to push paper feed block 4 to block paper feed passage 3, because rotation angle of the safety cover 2 is less than the limiting rotation angle, and because tension spring 5 can apply sufficient opposing force to permit the shredder to operate normally.

Figure 4:
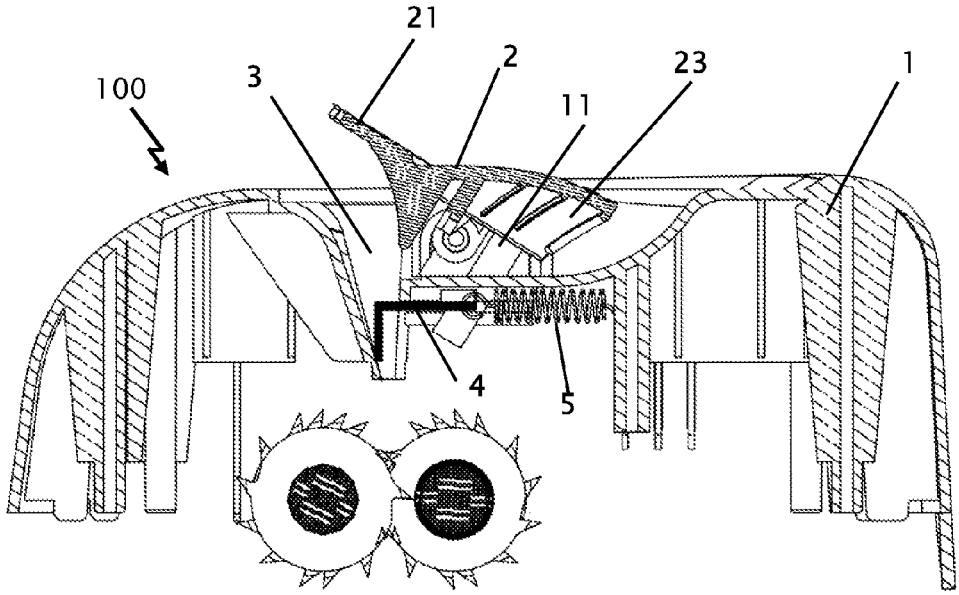
FIG. 4 is a partial section view of the shredder as shown in FIG. 3, depicting operation with the shredder feed inlet being overfed with paper or foreign matter, in accordance with the teachings of the present invention.

When excessive paper or foreign matter are introduced into paper feed passage 3, safety cover 2 continues to rotate in response, tending to create a larger passage gap. As shown in FIG. 4, studs 23 on second end section 22 of safety cover 2 then apply a pushing force to paper feed block 4 that can be sufficient to overcome the opposing tension force of elastic member 5. In response, paper feed passage block 4 can move forward and substantially completely close paper feed passage 3. Accordingly, safety inlet apparatus 100 can prevent overloading paper feed passage 3 with an excessive thickness of paper or foreign matter, and may provide the user with safer and more reliable operation.

Figure 5:
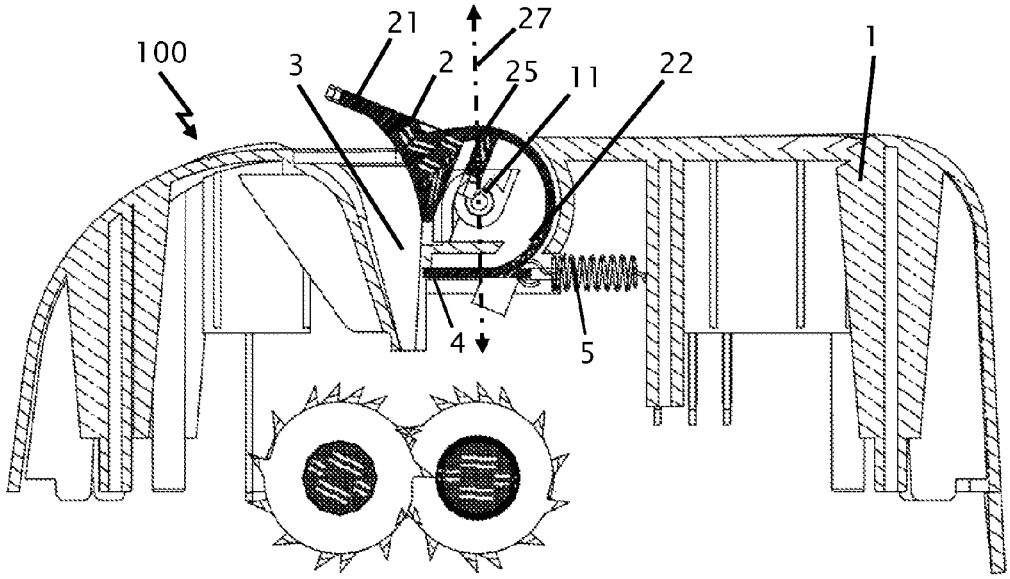
FIG. 5 is a partial section view of the shredder in is a partial cross-sectional view of the shredder embodiment in normal operation teachings of the present invention.
Figure 6:
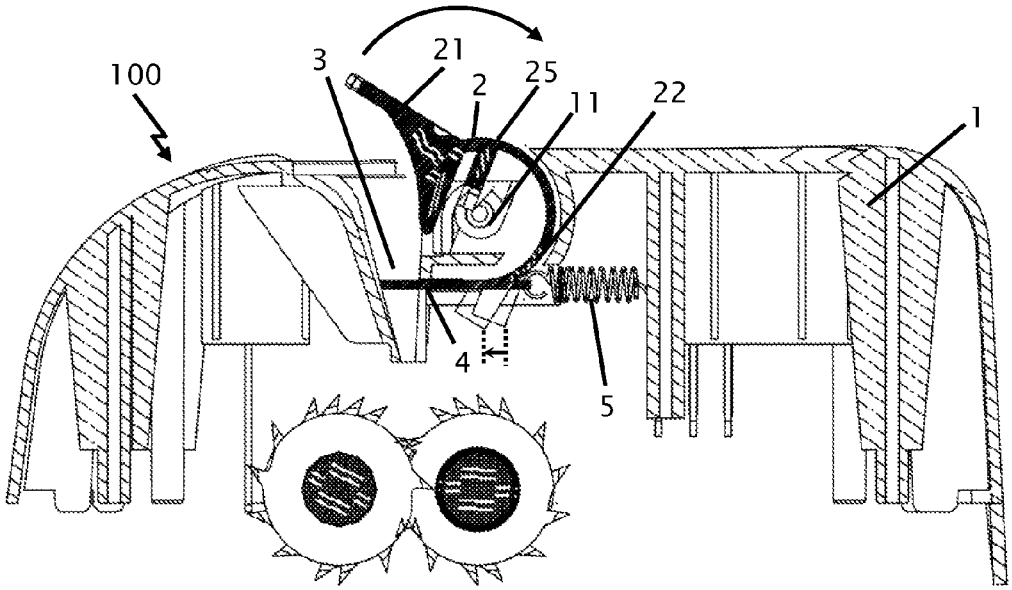
FIG. 6 is a partial section view of the shredder as shown in FIG. 5, depicting operation with the shredder feed inlet being overfed with paper or foreign matter, in accordance with the teachings of the present invention.

FIGS. 5-6 are partial section views of a shredder illustrating other example embodiments of safety inlet apparatus 100. In the example embodiments represented by FIGS. 5-6, paper feed passage block 4 can be connected to the second end section 22, and may not be provided as an unattached element. In some example embodiments, paper feed passage block 4 can be fixed to second end section 22. In certain ones of these example embodiments, paper feed passage block 4 can be integrated with second end section 22. Alternately, paper feed passage block 4 and second end section 22 can be provided as separate parts that can be cooperatively connected, such that when safety cover 2 is rotated by a predefined angle, the pushing force applied to paper feed passage block 4 is sufficient to overcome the opposing tension force of the tension spring, which can cause paper feed passage block 4 to move forward to close paper feed passage 3 substantially completely.

When no paper is fed into shredder 105, inlet to paper feed passage 3 is covered by safety cover 2, and, in general, is tightly closed. This action is similar to the embodiments illustrated in FIGS. 1-4. When shredder 105 is in use, safety cover 2 can be rotated up to a selected operational angle to form a gap for paper feeding, allowing paper to pass through open paper feed passage 3. In this configuration, second end section 22 of safety cover 2, which may be integral with paper feed block 4, may fail to push paper feed block 4 into paper feed passage 3. Because the rotation angle of the safety cover 2 is equal to or less than the selected operational angle and tension spring 5 can apply sufficient opposite force to allow paper feed passage 3 to remain unblocked and operational. However, when an excessive amount of paper, or foreign matter, enters paper feed passage 3, safety cover 2 can continue to rotate from the pushing force of the excessive paper or foreign matter, urging safety cover to be opened greater than the selected operational angle, causing paper feed block 4 into paper feed passage 3, and blocking the inlet of paper feed passage 3.

As shown in FIG. 6, in response to excessive paper or foreign matter being introduced into the inlet of paper feed passage 3, second end section 22 of safety cover 2 then applies a pushing force to paper feed block 4 that can overcome the opposing force of tension spring 5, causing paper feed block 4 to move forward until feed passage 3 is substantially completely closed. This action may stop overloading of feed passage 3, for example, by excess paper or by foreign matter, and may provide the user with safer and more reliable operation. In sum, the creatively designed safety inlet apparatus for a paper feed opening of a shredder herein is simply structured, may enhance features of safety, reliability, low cost, usefulness and convenience, and may find wide application.

Although the present invention has been described in terms of example embodiments, it is to be understood that neither the Specification nor the Drawings are to be interpreted as limiting. Various alternations and modifications are inherent, or will become apparent to those skilled in the art after reading the foregoing disclosure. Accordingly, it is intended that the appended claims be interpreted as covering all alternations and modifications that are encompassed by the spirit and the scope of the invention.

What is claimed is:

1. A safety inlet apparatus for a paper feed opening of a shredder, comprising:

an upper cover having a paper feed passage with a passage entrance and having an upper cover inner wall, and a safety cover having a first end section and a second end section, the safety cover being rotatably coupled to the upper cover, wherein the safety cover first end section is rotatable to cover the passage entrance, a paper feed passage block connected to the second section, slidably arranged on the upper cover toward paper feed passage, and limiting safety cover movement; and an elastic member having ends respectively connected to the upper cover inner wall of said and to said paper feed passage block, wherein movement of the elastic member resiliently actuates the safety cover to rotate toward closure of the passage entrance.

2. The safety inlet apparatus according to claim 1, wherein the paper feed passage block is fixed to the second end section.

3. The safety inlet apparatus, according to claim 1, wherein the paper feed passage block is integrated with the second end section.

4. The safety inlet apparatus according to claim 1, wherein paper feed passage block is disposed between the paper feed passage and the elastic member.

5. The safety inlet apparatus according to claim 4, wherein the elastic member comprises a tension spring.

6. The safety inlet apparatus according to claim 1, wherein at least one stud is provided on the second end section, and wherein the at least one stud is limited by the paper feed passage block.

7. The safety inlet apparatus according to claim 1, wherein the safety cover is pivotably coupled to the upper cover.

8. The safety inlet apparatus according to claim 7, further comprising:

rotating axles provided on sides of the safety cover;

axle seats facingly disposed on the upper cover, wherein the axel seats are positioned to receive a respective rotating axel, and wherein the rotating axels of the safety cover are respectively mounted in the axle seats.

* * * * *